US008813658B2

(12) United States Patent
Storteboom et al.

(10) Patent No.: US 8,813,658 B2
(45) Date of Patent: Aug. 26, 2014

(54) LOW FRICTION SHIPPING PLATFORM

(71) Applicant: CHEP Technology Pty Limited, Sydney (AU)

(72) Inventors: John Thomas Storteboom, Orlando, FL (US); Oivind Brockmeier, Medford, MA (US); Brandon M. D'Emidio, Orlando, FL (US); Timothy R. Proulx, Nashua, NH (US); Gregory S. Burkett, Cambridge, MA (US); Jeffrey R. Chapin, Cambridge, MA (US); Kenneth M. Brandt, Orlando, FL (US)

(73) Assignee: CHEP Technology Pty Limited, Sydney NSW (AU)

( * ) Notice: Subject to any disclaimer, the term of this patent is extended or adjusted under 35 U.S.C. 154(b) by 0 days.

(21) Appl. No.: 13/716,090

(22) Filed: Dec. 15, 2012

(65) Prior Publication Data

US 2013/0174763 A1 Jul. 11, 2013

Related U.S. Application Data

(60) Provisional application No. 61/576,983, filed on Dec. 17, 2011.

(51) Int. Cl.
*B65D 19/00* (2006.01)

(52) U.S. Cl.
USPC ..... 108/51.11; 108/56.1

(58) Field of Classification Search
USPC ..... 108/51.11, 55.3, 57.12, 56.3, 56.1
See application file for complete search history.

(56) References Cited

U.S. PATENT DOCUMENTS

| | | | | | |
|---|---|---|---|---|---|
| 2,201,551 | A * | 5/1940 | Welk | 411/339 |
| 2,797,605 | A * | 7/1957 | Metze, Jr. et al. | 411/339 |
| 2,930,560 | A * | 3/1960 | Carnwath et al. | 108/56.1 |
| 3,207,096 | A * | 9/1965 | Munroe | 108/51.11 |
| 3,483,787 | A * | 12/1969 | Saunders | 411/510 |
| 3,722,430 | A * | 3/1973 | Woodley et al. | 108/57.31 |
| 4,267,781 | A * | 5/1981 | Powers | 108/56.1 |
| 4,604,014 | A * | 8/1986 | Frano | 108/56.3 |
| 5,191,843 | A * | 3/1993 | Ausavich et al. | 108/56.3 |
| 5,351,628 | A * | 10/1994 | Breezer et al. | 108/56.1 |
| 5,445,084 | A * | 8/1995 | Durand | 108/56.3 |
| 5,603,266 | A * | 2/1997 | Nash | 108/56.3 |
| 5,649,492 | A * | 7/1997 | Chin-Shu | 108/51.3 |
| 5,960,721 | A * | 10/1999 | Huetteman et al. | 108/57.17 |
| 7,938,070 | B2 * | 5/2011 | Shea | 108/56.3 |
| 8,291,837 | B2 * | 10/2012 | Kirkpatrick | 108/56.1 |
| 2004/0025756 | A1 * | 2/2004 | Baker et al. | 108/51.11 |

* cited by examiner

*Primary Examiner* — Jose V Chen
(74) *Attorney, Agent, or Firm* — Ido Tuchman

(57) ABSTRACT

A system may include a bottom deck to a shipping platform. The system may also include a component affixed to the bottom member opposite the shipping platform's top to lower static coefficient of friction between the component and a floor the shipping platform in its load bearing usage position is resting on.

10 Claims, 11 Drawing Sheets

LOW FRICTION SHIPPING PLATFORM

RELATED APPLICATIONS

This application claims the benefit of U.S. Provisional Patent Application No. 61/576,983, filed on Dec. 17, 2011, entitled "Low Friction Shipping Platform" and having an the entire subject matter of which is incorporated herein by reference in its entirety.

BACKGROUND

Shippers, manufacturers, wholesalers, retailers, and/or the like move merchandise, materials, and/or the like (e.g. load, to customers, end-users, and/or the like) on shipping platforms (e.g. pallet, containers, and/or the like). This technique of bulk shipping may reduce the cost related to moving the load when compared to non-bulk shipping methods. As a result, all parties in the distribution chain may benefit from lower shipping costs due to this bulk shipping technique.

There are a number of issues with the above described technique. One issue is that shipping platforms are exposed to a harsh operating environment. Another issue is the shipping platform may be restricted in any number of ways by regulatory and/or standardization requirements.

SUMMARY

According to one embodiment, a system may include a bottom member to a shipping platform. The system may also include a component affixed to the bottom member opposite the shipping platform's top to lower static coefficient of friction between the component and a floor the shipping platform in its load bearing usage position is resting on.

The component may comprise plastic, nylon, metal, polytetrafluoroethylene, wood, composites, banding, ultra-high-molecular-weight polyethylene, polyoxymethylene, and polymer applications. The component may be affixed to the bottom member by nails, screws, fasteners, adhesion, banding, and/or joinery.

The component may be partially recessed into the bottom member. The component may be affixed to each corner of the shipping platform.

The component may be also affixed within an area defined by the shipping platform's four corners. The component may taper away from the bottom member. The component may comprise a plurality of components affixed to a corner of the shipping platform.

Another aspect of the embodiments is a method. The method may include providing a shipping platform. The method may also include affixing a component to a bottom member opposite the shipping platform's top to lower static coefficient of friction between the component and a floor the shipping platform in its load bearing usage position is resting on.

The method may further include selecting the component based upon its lower coefficient of friction relative to the bottom member. The method may additionally include selecting the ablation rate of the component.

The method may also include positioning the component on the bottom member based upon the shipping platform's load bearing design. The method may further include selecting the component's shape to reduce snags.

The method may additionally include banding the component to the shipping platform. The method may also include reducing splitting of the bottom member via the banding. The method may further include affixing a component to each corner of the shipping platform.

An alternative embodiment of the system may include a bottom deck to a shipping platform. The system may also include a component affixed to the bottom member opposite the shipping platform's top to lower static coefficient of friction between the component and a floor the shipping platform in its load bearing usage position is resting on, the component comprises at least one of plastic, polytetrafluoroethylene, ultra-high-molecular-weight polyethylene, polyoxymethylene, wood, composites, nylon, metal, banding, and polymer applications, and the component is affixed to each corner of the shipping platform.

DETAILED DESCRIPTION

Embodiments will now be described more fully hereinafter with reference to the accompanying drawings, in which preferred embodiments are shown. Like numbers refer to like elements throughout.

Figure 1:
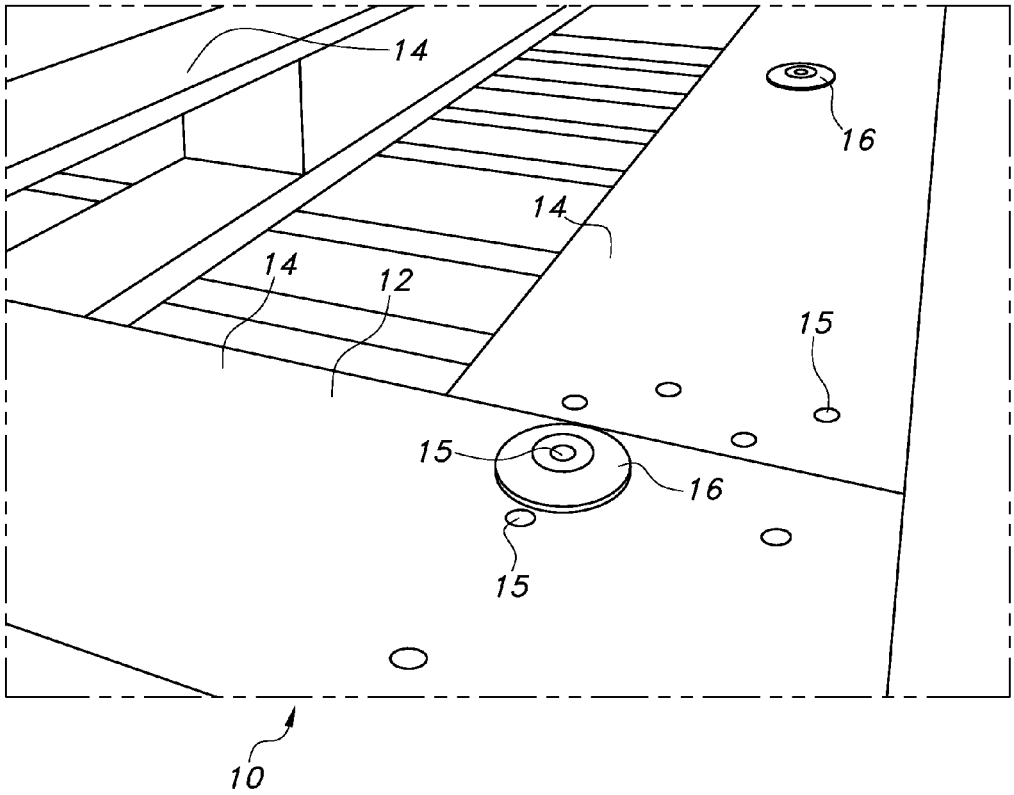
FIG. 1 illustrates an upside down shipping platform with a low friction component in accordance with the invention.

FIG. 1 illustrates a common form of a shipping platform 12 that is often referred to as a pallet, which in this picture is upside down to show the bottom of the shipping platform. In this embodiment, the shipping platform 12 is fabricated out of members 14 joined together by metal fasteners 15 such as nails. The members 14 comprise wood, metal, plastic, composite materials, and/or the like. The joining areas comprise insertion points for fasteners 15 such as nails, screws, dowels, and/or the like. In other embodiments, the joining areas are adhered or welded together. The members 14 are arranged into a shipping platform 12 configuration and joined together by fasteners 15 in the joining areas as will be appreciated by those of skill in the art.

In one embodiment, the system 10 includes a component 16 that is added to a structural member 14 on the bottom of the shipping platform 12 to reduce the amount of friction between the shipping platform and the floor 17. The component 16 comprises plastic, polytetrafluoroethylene (PTFE), ultra-high-molecular-weight polyethylene (UHMWPE), wood, polyoxymethylene (POM), nylon, metal, banding, composites, polymer applications, and/or the like. In one embodiment, the component 16 is affixed to the structural member 14 on the bottom of the shipping platform 12 with nails, screws, adhesive, joinery, and/or the like.

Addition of the component 16 to the bottom of the shipping platform 12 reduces the amount of friction between the shipping platform and the floor 17. In some cases, the component 16 can lower bottom deck friction of the shipping platform 12 with the floor 17 by ⅔rds.

As a result, the lower bottom deck friction decreases reaction forces experienced by pallet 12. For example, a loaded pallet 12 has a high static coefficient of friction due to the load, and when a forklift engages the loaded pallet, the loaded pallet readily resists movement because of the high static coefficient of friction. In other words, any impulse force imparted by the forklift to the loaded pallet 12 is greatly absorbed by the pallet's structural members 14 and joining areas because the loaded pallet readily resists movement.

In contrast, a similarly loaded pallet 12 with components 16 on the bottom to reduce the static coefficient of friction will experience less impact damage to the pallet's structural members 14, e.g. lead boards and blocks, and joining areas because the loaded pallet is less resistant to movement than a loaded pallet without the low friction feet. Stated another way, because the loaded pallet 12 with components 16 has a lower static coefficient of friction, energy transmitted by a forklift to the pallet is limited to a lower threshold than a loaded pallet without the components 16, e.g. low friction feet.

Further, components 16, e.g. low friction feet, provide additional benefits such as facilitating pin-wheeling and bulldozing of the pallets 12 by a forklift operator. As a result, the components 16, e.g. low friction feet, lowers the pallet's 12 lifetime cost because the pallet is exposed to lower impulse forces over its lifetime of use. In other words, the pallet 12 absorbs less energy over its lifetime because of the lower static coefficient of friction provided by the components 16.

Figure 2:
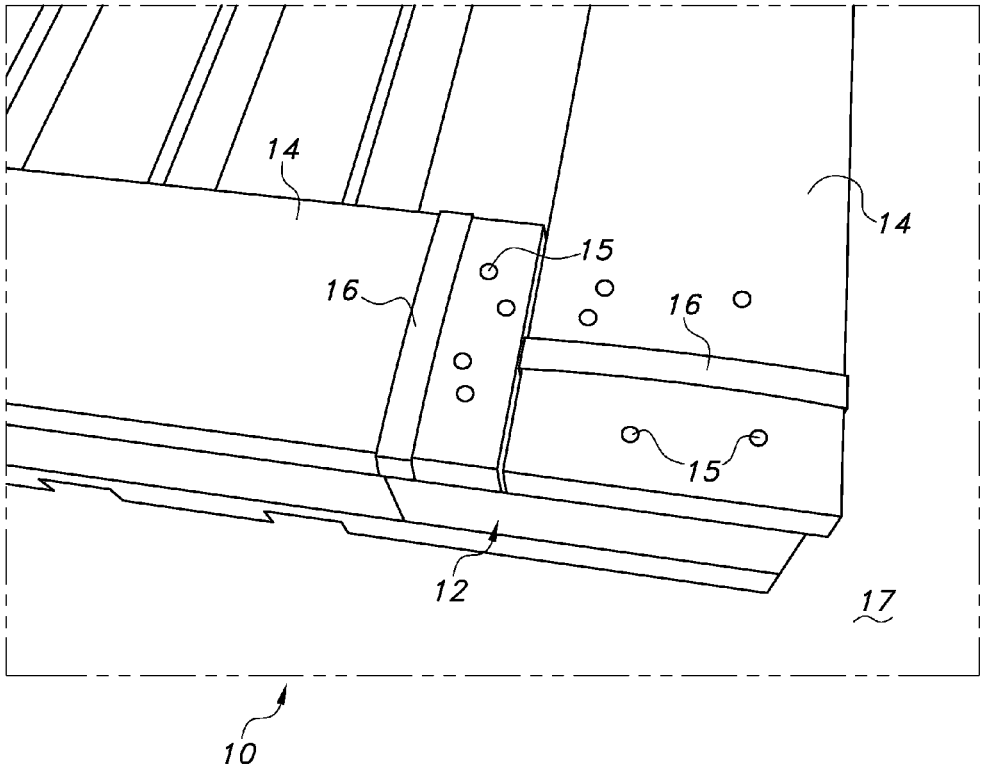
FIG. 2 illustrates an alternative low friction component on an upside down shipping platform in accordance with the invention.

With reference now to FIG. 2, another embodiment of system 10 utilizing components 16 for an improved shipping platform 12 is described. In this embodiment, components 16 comprise low friction banding material wrapped around the pallet's 12 structural members 14. The banding material comprises tape, banding strap, PVC heat shrink tubing, and/or the like. The banding material binds any of the structural members 14 around the joining areas, for example. In one embodiment, the banding material is applied to the structural members 14 either before or after the fasteners 15 are applied to the joining areas.

The banding material may help to keep the structural members 14 from splitting during fastener insertion 15. The combination, e.g. composite, of the structural members 14 and the banding material may also increase the durability of the joint in the joining areas when compared to a shipping platform 12 without the combination in its joining area.

Figure 3:
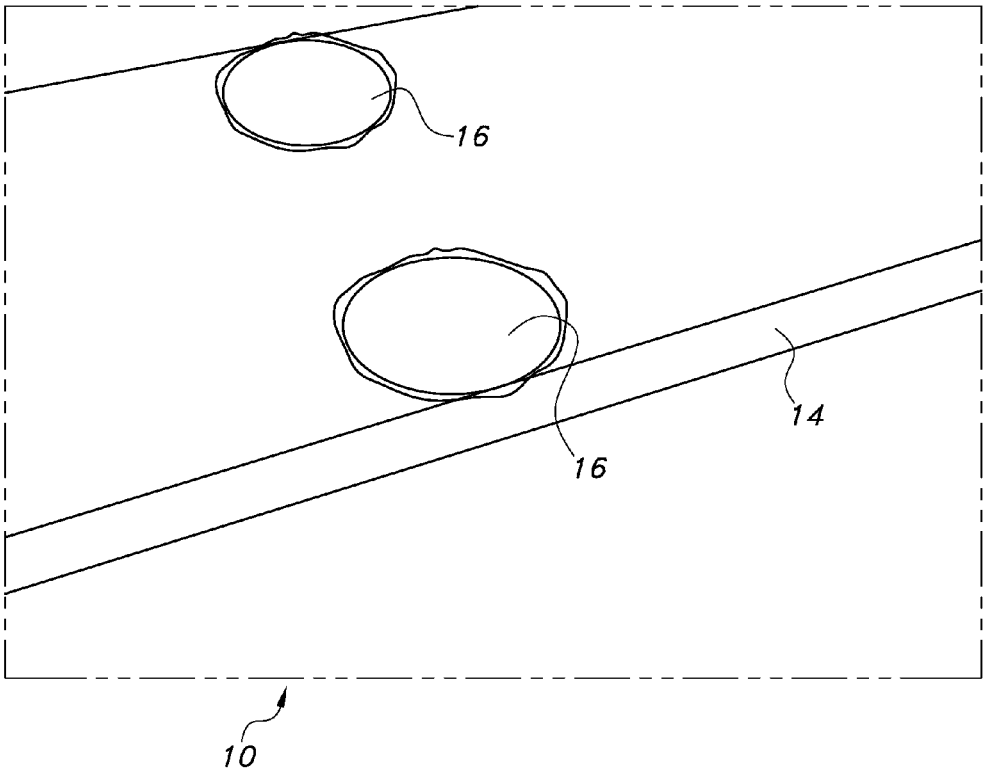
FIG. 3 illustrates another alternative low friction component on the bottom side of a member in accordance with the invention.

With reference now to FIG. 3, another embodiment of system 10 utilizing components 16 for an improved shipping platform 12 is described. In this embodiment, components 16 comprise a low friction polymer applied to the pallet's 12 structural members 14. The low friction polymer has a very low profile and is very easy to apply to an existing pool of pallets 12.

The system 10 addresses durability issues of shipping platforms 12 while also keeping the shipping platforms within standardization requirements. In other words, system 10 changes the dimensions of a shipping platform 10 very little. As a result, system 10 can be deployed with little impact to the overall system in which the shipping platforms 12 flow. In addition, the system 10 also provides a retrofit option that can be deployed to improve an existing pool of shipping platforms 12.

In another embodiment, the system 10 includes a bottom member 14 to a shipping platform 12. The system 10 also includes a component 16 affixed to the bottom member 14 opposite the shipping platform's 12 top to lower static coefficient of friction between the component and a floor 17 the shipping platform in its load bearing usage position is resting on.

In one embodiment, the component 16 comprises plastic, nylon, metal, polytetrafluoroethylene, wood, composites, banding, ultra-high-molecular-weight polyethylene, polyoxymethylene, and polymer applications. In another embodiment, the component 16 is affixed to the bottom member 14 by nails, screws, fasteners, adhesion, banding, and/or joinery.

In one embodiment, the component 16 is partially recessed into the bottom member 14. In another embodiment, the component 16 is affixed to each corner of the shipping platform 12.

In one embodiment, the component 16 is also affixed within an area defined by the shipping platform's 12 four corners. In another embodiment, the component 16 tapers away from the bottom member 14. In another embodiment, the component 16 comprises a plurality of components affixed to a corner of the shipping platform 12.

Another aspect of the embodiments is a method. The method may include providing a shipping platform. The method may also include affixing a component to a bottom member opposite the shipping platform's top to lower static coefficient of friction between the component and a floor the shipping platform in its load bearing usage position is resting on.

Figure 4:
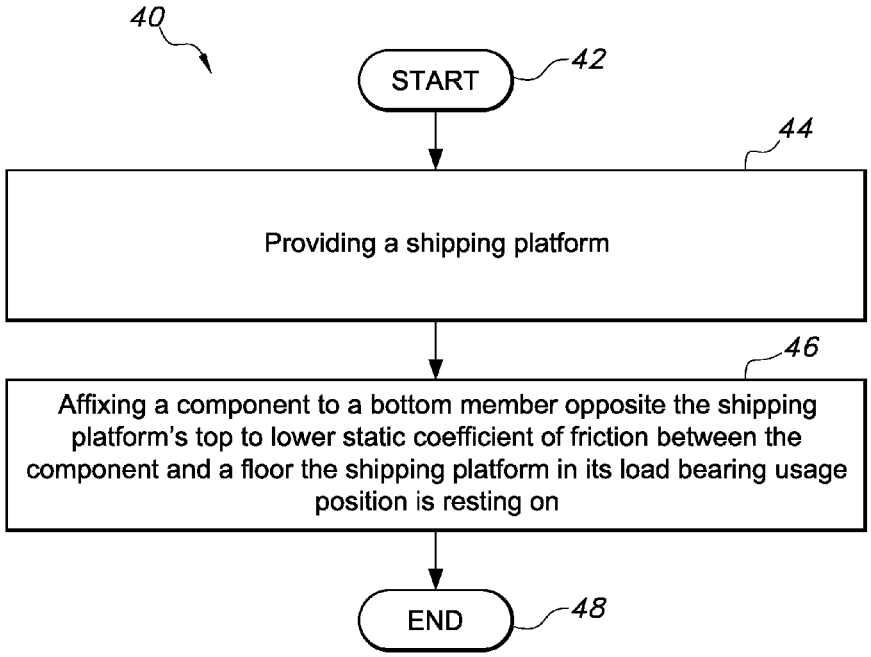
FIG. 4 is a flowchart illustrating method aspects according to embodiments.

Another aspect of the embodiments is a method, which is now described with reference to flowchart 40 of FIG. 4. The method begins at Block 42 and may include providing a shipping platform at Block 44. The method may also include joining a T1 lead-board structurally different from the shipping platform's top deck to an edge of the top deck at Block 46. The method ends at Block 48.

Figure 5:
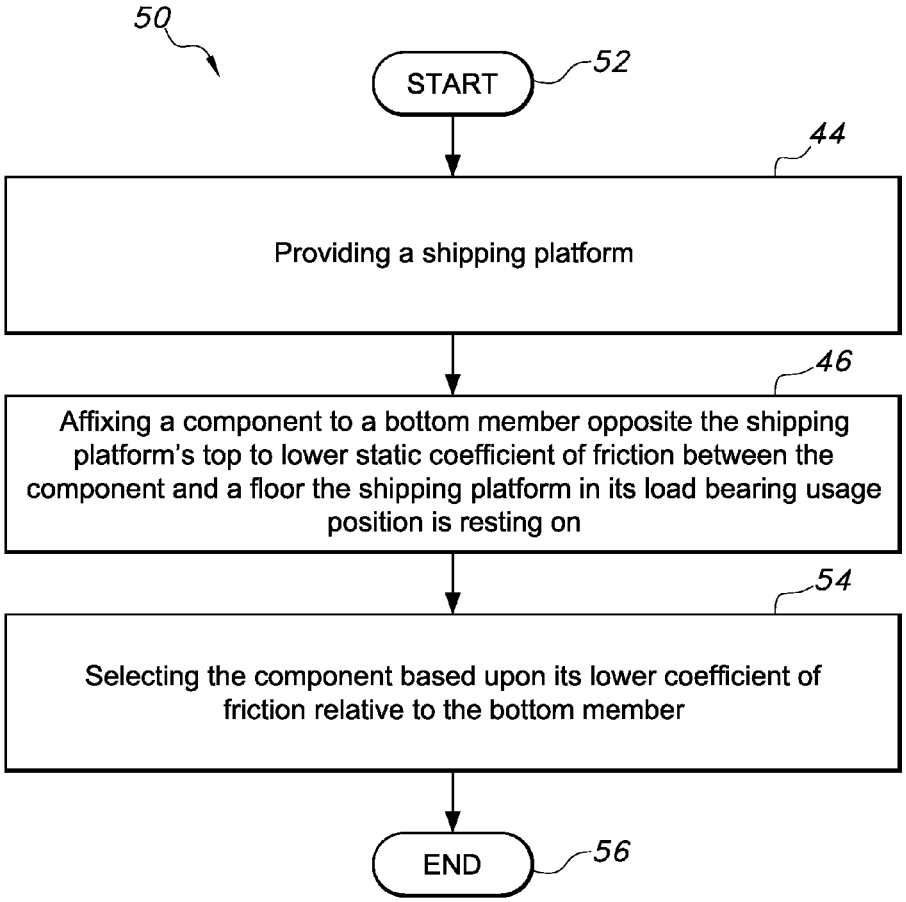
FIG. 5 is a flowchart illustrating method aspects according to the method of FIG. 4.

In another method embodiment, which is now described with reference to flowchart 50 of FIG. 5, the method begins at Block 52. The method may include the steps of FIG. 4 at Blocks 44 and 46. The method may additionally include adding lightening holes and/or lightening reliefs to the T1 lead-board at Block 54. The method ends at Block 56.

Figure 6:
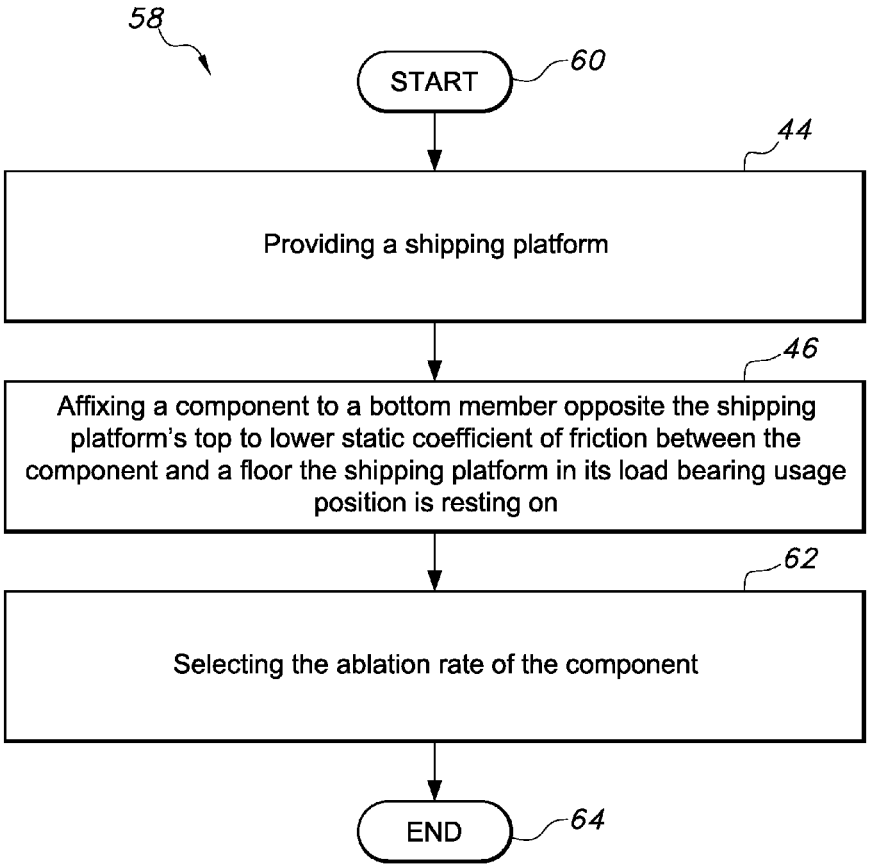
FIG. 6 is a flowchart illustrating method aspects according to the method of FIG. 4.

In another method embodiment, which is now described with reference to flowchart 58 of FIG. 6, the method begins at Block 60. The method may include the steps of FIG. 4 at Blocks 44 and 46. The method may further include providing structural support for the T1 lead-board via a metal component at Block 62. The method ends at Block 64.

Figure 7:
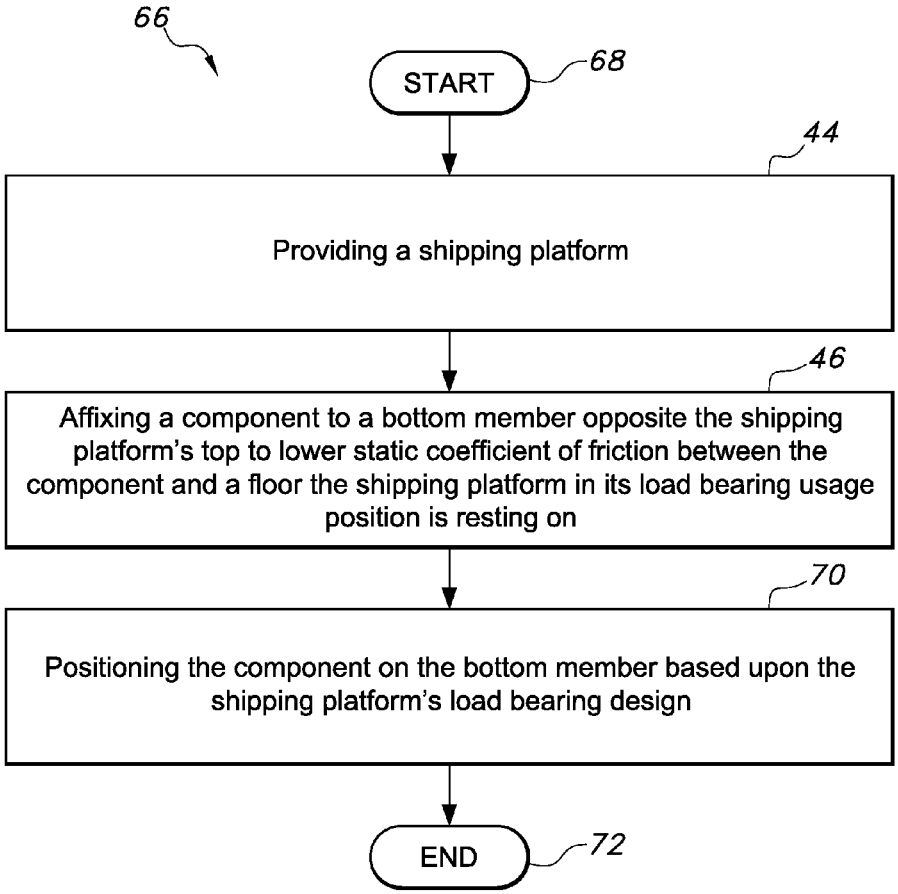
FIG. 7 is a flowchart illustrating method aspects according to the method of FIG. 4.

In another method embodiment, which is now described with reference to flowchart 66 of FIG. 7, the method begins at Block 68. The method may include the steps of FIG. 4 at Blocks 44 and 46. The method may further include positioning fasteners used to connect the T1 lead-board to the shipping platform's top deck via an insert carried by the T1 lead-board at Block 70. The method ends at Block 72.

Figure 8:
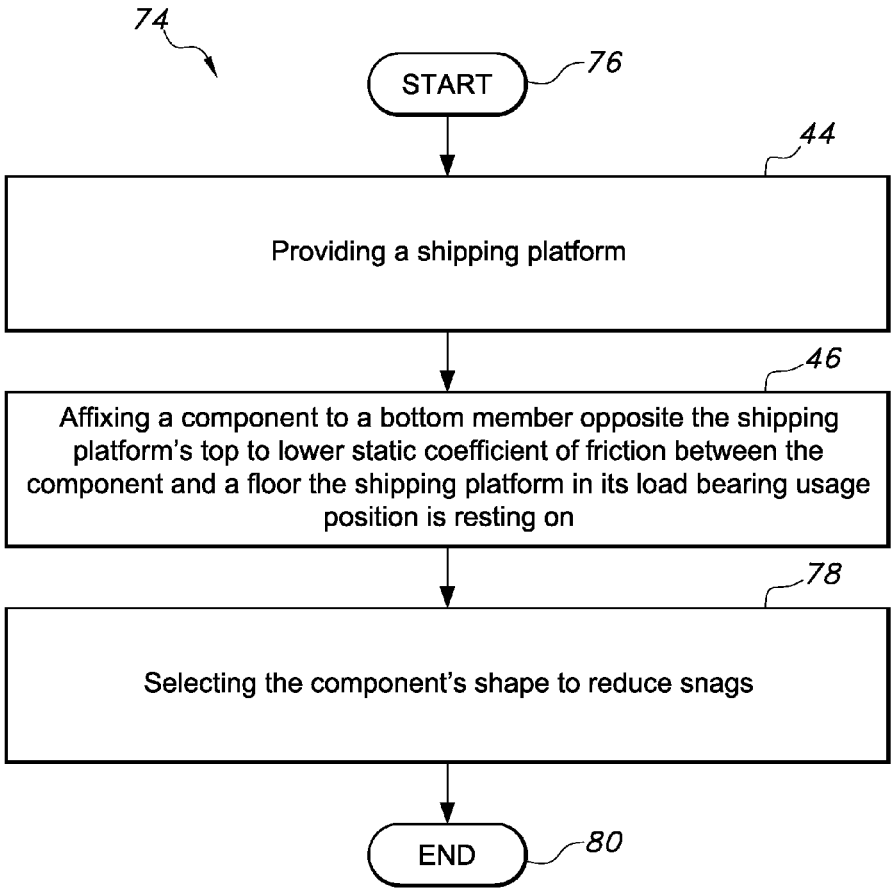
FIG. 8 is a flowchart illustrating method aspects according to the method of FIG. 4.

In another method embodiment, which is now described with reference to flowchart 74 of FIG. 8, the method begins at Block 76. The method may include the steps of FIG. 4 at Blocks 44 and 46. The method may additionally include providing a mechanical joint between the shipping platform's top deck and the T1 lead-board via pins carried by the T1 lead-board at Block 78. The method ends at Block 80.

Figure 9:
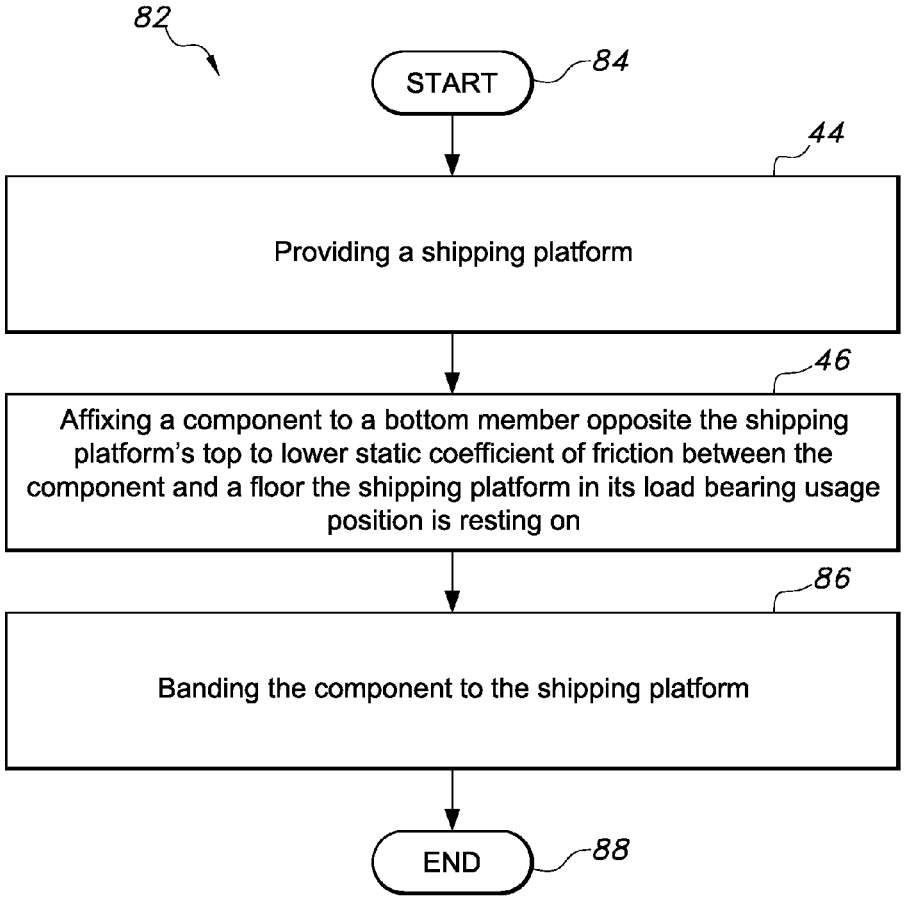
FIG. 9 is a flowchart illustrating method aspects according to the method of FIG. 4.

In another method embodiment, which is now described with reference to flowchart 82 of FIG. 9, the method begins at Block 84. The method may include the steps of FIG. 4 at Blocks 44 and 46. The method may further include banding the component to the shipping platform at Block 86. The method ends at Block 88.

Figure 10:
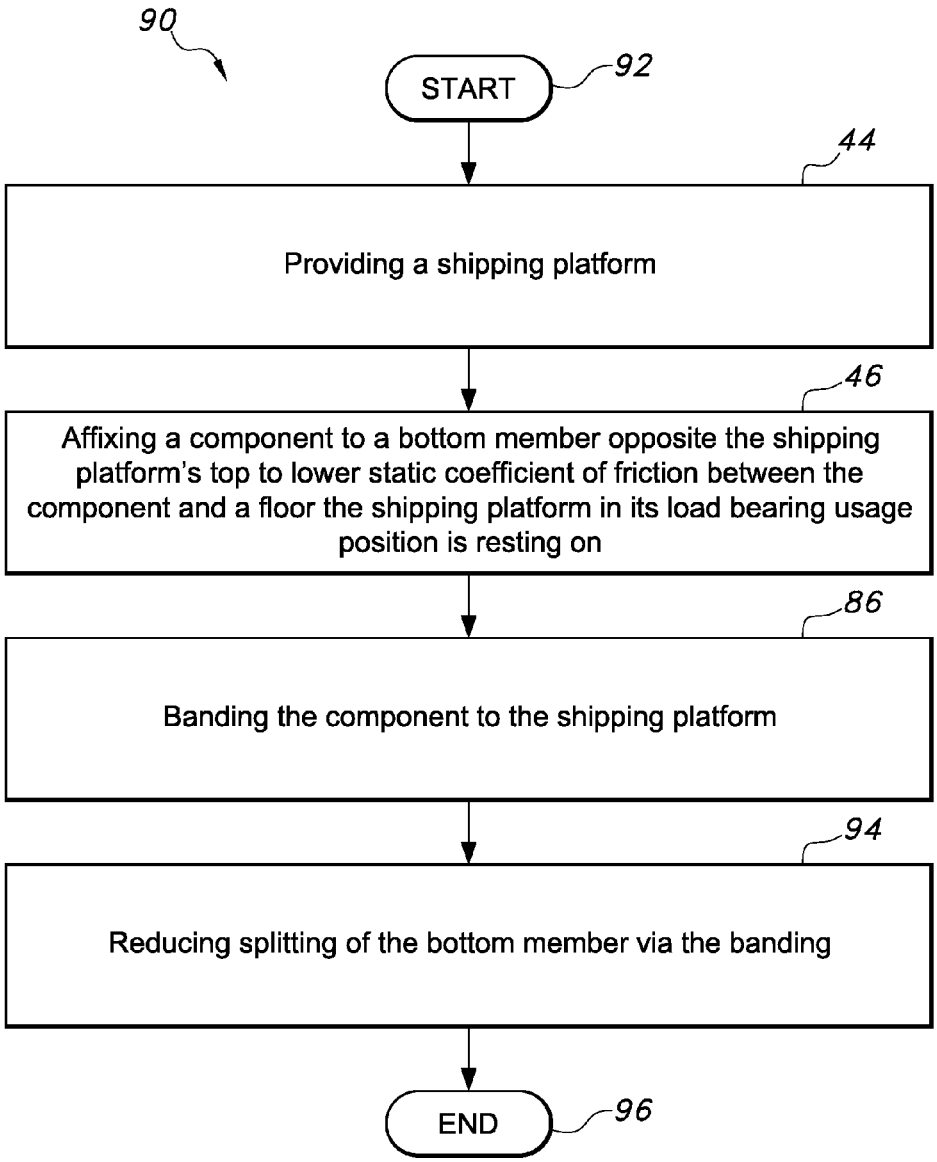
FIG. 10 is a flowchart illustrating method aspects according to the method of FIG. 9.

In another method embodiment, which is now described with reference to flowchart 90 of FIG. 10, the method begins at Block 92. The method may include the steps of FIG. 9 at Blocks 44, 46 and 86. The method may further include reducing splitting of the bottom member via the banding at Block 94. The method ends at Block 96.

Figure 11:
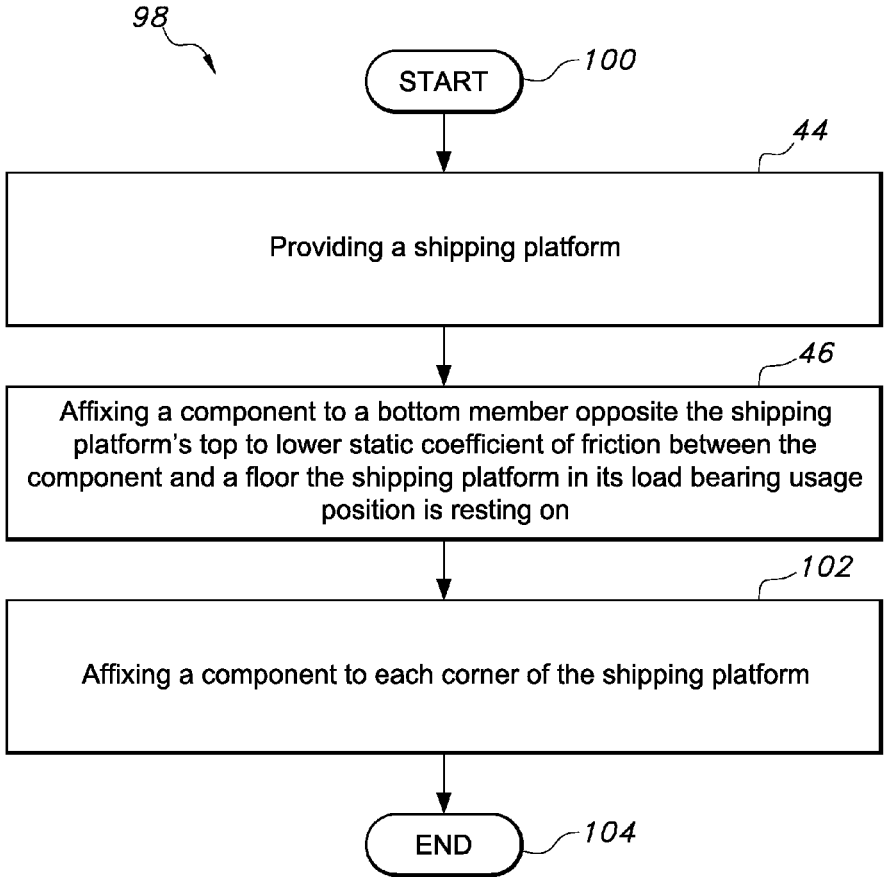
FIG. 11 is a flowchart illustrating method aspects according to the method of FIG. 4.

In another method embodiment, which is now described with reference to flowchart 98 of FIG. 11, the method begins at Block 100. The method may include the steps of FIG. 4 at Blocks 44 and 46. The method may further include affixing a component to each corner of the shipping platform at Block 102. The method ends at Block 104.

An alternative embodiment of the system 10 includes a bottom deck 18 to a shipping platform 12. The system 10 also includes a block 16 joined to the bottom deck 18, and a wooden top deck 14 joined to the block. The system 10 further include a T1 lead-board 20 fastened to an edge of the top deck 20 where the T1 lead-board comprises plastic, plastic-metal composite, metal, and/or plywood.

The method may further include selecting the component based upon its lower coefficient of friction relative to the bottom member. The method may additionally include selecting the ablation rate of the component.

The method may also include positioning the component on the bottom member based upon the shipping platform's load bearing design. The method may further include selecting the component's shape to reduce snags.

The method may additionally include banding the component to the shipping platform. The method may also include reducing splitting of the bottom member via the banding. The method may further include affixing a component to each corner of the shipping platform.

An alternative embodiment of the system may include a bottom deck to a shipping platform. The system may also include a component affixed to the bottom member opposite the shipping platform's top to lower static coefficient of friction between the component and a floor 17 the shipping platform in its load bearing usage position is resting on, the component comprises at least one of plastic, polytetrafluoroethylene, ultra-high-molecular-weight polyethylene, polyoxymethylene, wood, composites, nylon, metal, banding, and polymer applications, and the component is affixed to each corner of the shipping platform.

The system 10 addresses durability issues of shipping platforms 12 while also keeping the shipping platforms within standardization requirements. In other words, system 10 changes the dimensions of a shipping platform 10 very little, if at all. As a result, system 10 can be deployed with little impact to the overall system in which the shipping platforms 12 flow. In addition, the system 10 also provides a retrofit option that can be deployed to improve an existing pool of shipping platforms 12.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the embodiments. The embodiment was chosen and described in order to best explain the principles of the embodiment and the practical application, and to enable others of ordinary skill in the art to understand the various embodiments with various modifications as are suited to the particular use contemplated.

It should be noted that in some alternative implementations, the functions noted in a flowchart block may occur out of the order noted in the figures. For instance, two blocks shown in succession may, in fact, be executed substantially concurrently, or the blocks may sometimes be executed in the reverse order, depending upon the functionality involved because the flow diagrams depicted herein are just examples. There may be many variations to these diagrams or the steps (or operations) described therein without departing from the spirit of the embodiments. For example, the steps may be performed concurrently and/or in a different order, or steps may be added, deleted, and/or modified. All of these variations are considered a part of the claimed embodiments.

While the preferred embodiment have been described, it will be understood that those skilled in the art, both now and in the future, may make various improvements and enhancements which fall within the scope of the claims which follow. These claims should be construed to maintain the proper protection for the embodiments first described.

What is claimed is:

1. A system comprising:

a bottom member to a shipping platform; and a banding wrapped around the bottom member opposite the shipping platform's top to lower static coefficient of friction between the banding and a floor the shipping platform in its load bearing usage position is resting on.

2. The system of claim 1 wherein the banding comprises at least one of plastic, polytetrafluoroethylene, ultra-high-molecular-weight polyethylene, polyoxymethylene, composites, nylon, and metal banding.

3. The system of claim 1 wherein the banding is affixed to the bottom member by at least one of nails, screws, fasteners, adhesion, and joinery.

4. The system of claim 1 wherein the banding is affixed to each corner of the shipping platform.

5. The system of claim 4 wherein the banding is also affixed within an area defined by the shipping platform's four corners.

6. The system of claim 1 wherein the banding comprises a plurality of components affixed to a corner of the shipping platform.

7. The system of claim 1 wherein a portion of the banding is position between the bottom member and the shipping platform's top.

8. A system comprising:

a bottom member to a shipping platform; and a banding wrapped around the bottom member opposite the shipping platform's top to lower static coefficient of friction between the banding and a floor the shipping platform in its load bearing usage position is resting on, the banding comprises at least one of plastic, polytetrafluoroethylene, ultra-high-molecular-weight polyethylene, polyoxymethylene, composites, nylon, and metal banding, and the banding is affixed to each corner of the shipping platform; and wherein a portion of the banding is position between the bottom member and the shipping platform's top.

9. The system of claim 8 wherein the banding is affixed to the bottom member by at least one of nails, screws, fasteners, adhesion, banding, and joinery.

10. The system of claim 8 wherein the banding is also affixed within an area defined by the shipping platform's four corners.

* * * * *